US005265759A

United States Patent [19]

Coffin

[11] Patent Number: 5,265,759

[45] Date of Patent: Nov. 30, 1993

[54] ARRANGEMENT FOR THE ACCOMMODATION AND SALES DISPLAY OF RAZOR BLADE UNITS OF WET RAZORS PACKAGED IN DISPENSERS

[75] Inventor: Dave Coffin, Norwich, United Kingdom

[73] Assignee: Wilkinson Sword Gesellschaft mit beschränkter Haftung, Solingen, Fed. Rep. of Germany

[21] Appl. No.: 898,394

[22] Filed: Jun. 11, 1992

Related U.S. Application Data

[63] Continuation-in-part of Ser. No. 736,402, Jul. 26, 1991, abandoned.

[30] Foreign Application Priority Data

Aug. 2, 1990 [DE] Fed. Rep. of Germany ..... 9011304
Oct. 17, 1990 [DE] Fed. Rep. of Germany ..... 9014386

[51] Int. Cl.[5] ..... B65G 59/06

[52] U.S. Cl. ..... 221/123; 221/154; 221/155; 221/312 A

[58] Field of Search ..... 221/92, 123, 154, 155, 221/284, 312 A, 312 C; 186/2; 206/469, 499, 561, 264, 807, 228, 356

[56] References Cited

U.S. PATENT DOCUMENTS

| | | | |
|---|---|---|---|
| 916,503 | 3/1909 | Thompson | 206/807 X |
| 1,504,725 | 8/1924 | Schumacher | 206/228 |
| 1,595,649 | 8/1926 | De Ritis | 206/228 |
| 1,632,840 | 6/1927 | Kaufman | 206/228 |
| 1,741,889 | 12/1929 | Trnovec | 221/284 X |
| 1,791,594 | 2/1931 | Herring | 206/561 X |
| 1,821,365 | 9/1931 | Thompson et al. | 206/228 |
| 2,104,523 | 1/1938 | Lichtenstein | 206/499 X |
| 2,287,005 | 6/1942 | Greaves | 206/561 X |
| 2,295,313 | 9/1942 | Weir | 221/92 X |
| 2,519,949 | 8/1950 | Winton | 221/92 |
| 3,010,606 | 11/1961 | Heselov | 221/92 |
| 3,184,104 | 5/1965 | Domenico et al. | 221/94 |
| 3,185,373 | 5/1965 | Margulies | 221/123 |
| 3,568,883 | 3/1971 | Reynolds | 206/499 X |
| 3,696,915 | 10/1972 | Douglas . | |
| 3,815,808 | 6/1974 | Bunnell | 206/561 X |
| 3,833,146 | 9/1974 | Braginetz . | |
| 3,880,284 | 4/1975 | Pomfret . | |

(List continued on next page.)

FOREIGN PATENT DOCUMENTS

| | | |
|---|---|---|
| 662910 | 5/1963 | Canada . |
| 0290965 | 11/1988 | European Pat. Off. . |
| 0357991 | 3/1990 | European Pat. Off. . |
| 0373746 | 6/1990 | European Pat. Off. . |
| 128192 | 5/1901 | Fed. Rep. of Germany . |
| 2743646 | 9/1977 | Fed. Rep. of Germany . |
| 8614142 | 5/1986 | Fed. Rep. of Germany . |
| 3538768 | 5/1987 | Fed. Rep. of Germany . |
| 3707858 | 9/1987 | Fed. Rep. of Germany . |
| 8815554 | 12/1988 | Fed. Rep. of Germany . |
| 2245202 | 4/1975 | France . |
| 7918330 | 2/1980 | France . |
| 2599715 | 12/1987 | France . |
| 675870A5 | 11/1990 | Switzerland . |
| 377775 | 8/1932 | United Kingdom . |
| 872175 | 7/1961 | United Kingdom . |

*Primary Examiner*—Robert P. Olszewski
*Assistant Examiner*—Dean A. Reichard
*Attorney, Agent, or Firm*—Robert W. Becker & Associates

[57] ABSTRACT

An arrangement for the accommodation and sales display of essentially rectangular articles, preferably razor blade units, of wet razors, packed in dispensers. The arrangement comprises a sales dispensing unit for individually dispensing the articles. The unit comprises a housing having a front side, two side walls, and a bottom. The front side is provided with a withdrawal arrangement in the form of a slot-like opening that is disposed in the vicinity of the bottom of the housing. Each of the side walls is provided in the vicinity of the bottom of the housing with a respective recessed portion that cooperates with the slot-like opening of the front side. The articles are disposed in the housing in at least one row.

25 Claims, 3 Drawing Sheets

U.S. PATENT DOCUMENTS

| | | | |
|---|---|---|---|
| 3,970,194 | 7/1976 | Iten | 206/469 X |
| 4,000,832 | 1/1977 | Pentney . | |
| 4,034,892 | 7/1977 | Braginetz . | |
| 4,043,485 | 8/1977 | Tippetts | 206/499 X |
| 4,140,244 | 2/1979 | Clabby . | |
| 4,148,413 | 4/1979 | Immardino | 221/92 |
| 4,285,428 | 8/1981 | Beddall et al. . | |
| 4,593,816 | 6/1986 | Langenbeck | 206/564 X |
| 4,612,704 | 9/1986 | Berretti . | |
| 4,742,909 | 5/1988 | Apprille, Jr. et al. | 206/356 |
| 4,742,914 | 5/1988 | Klein | 206/806 X |
| 4,767,008 | 8/1988 | Warnecke et al. | 206/564 X |
| 4,767,022 | 8/1988 | Oldórf | 221/92 |
| 4,887,790 | 12/1989 | Wilkinson et al. | 206/561 X |
| 5,020,670 | 6/1991 | Bedford | 206/499 |

Fig.3
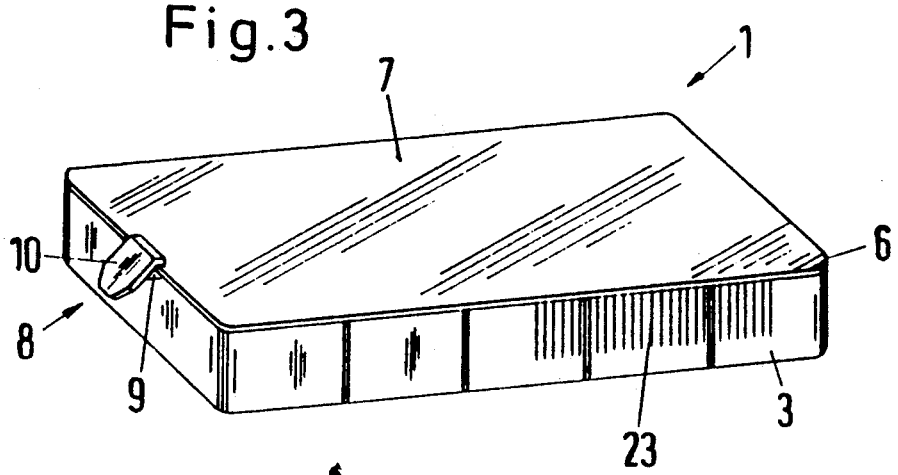
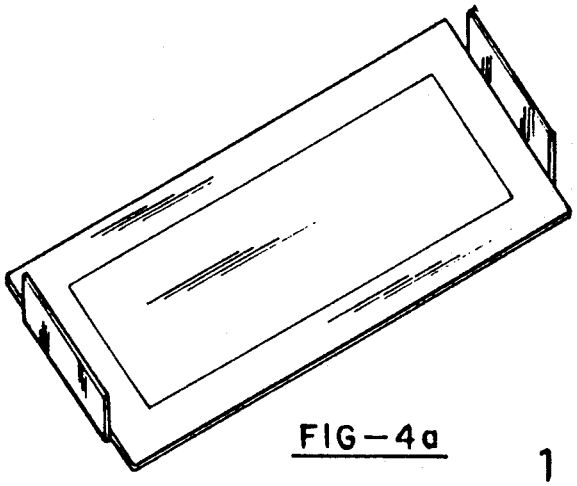
FIG—4a
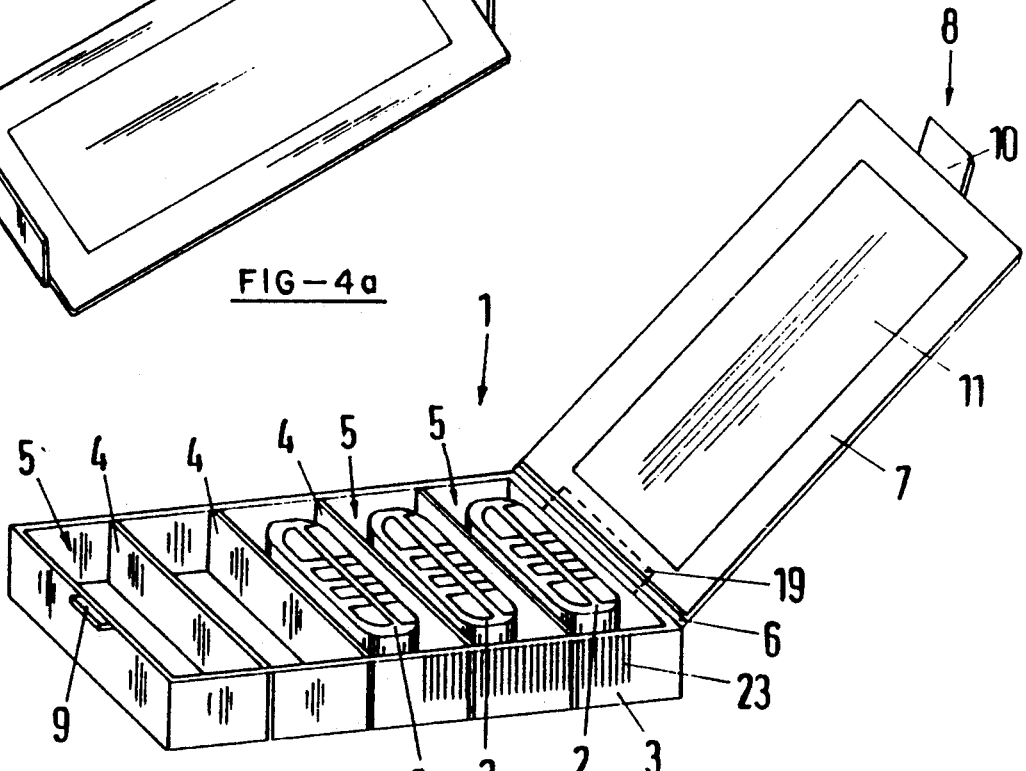
FIG 4

ARRANGEMENT FOR THE ACCOMMODATION AND SALES DISPLAY OF RAZOR BLADE UNITS OF WET RAZORS PACKAGED IN DISPENSERS

This application is a continuation-in-part of application Ser. No. 736,402 filed Jul. 26, 1991, now abandoned.

BACKGROUND OF THE INVENTION

The present invention relates to a combination of dispenser that contain razor blade units, and a sales display and dispensing unit for accommodating and individually dispensing such dispensers.

Dispensers or containers for accommodating razor blade units of wet razors are known. In this connection, razor blade unit refers to a plastic body in which a single or double razor blade is fixedly embedded, and which can be disposed at the front end of a handle via an appropriate mechanism. Dispensers serve for storing several such razor blade units as well as for the accommodation of used razor blade units. These dispensers comprise a plastic casing with appropriate compartments in conformity with the number of razor blade units; each of these compartments serves to receive a respective razor blade unit. By means of the handle, the razor blade units can be successively removed from the casing and after use can again be inserted therein.

In order to be able to hold the razor blade units in the compartments of the casing, clamping forces act upon the razor blade units, so that the razor blade units are held in the compartments of the casing via a frictional or positive connection. In order to be able to hold the razor blade units in the compartments with some degree of reliability, the clamping forces must be relatively great. Unfortunately, with the smaller razor blade units that are used these days, problems occur because these razor blade units cannot absorb great clamping forces, so that the heretofore known dispensers are not suitable for accommodating these smaller razor blade units. Furthermore, with the heretofore known dispensers the danger exists that if the dispensers are dropped, the razor blade units can become disengaged and fall out. This of course also applies in particular after the dispenser has been provided with used razor blade units. A number of such dispensers are, for example, offered for sale in so-called blister packages, with the dispensers being disposed next to one another below a transparent plastic sheet that is secured to a cardboard strip. Such packagings have the drawback that the used plastic is not compatible with the environment and that the dispensers for razor blade units are disposed next to one another, so that the dispensers require a large surface area.

It is therefore an object of the present invention to provide an arrangement of the aforementioned general type that can be made of environmentally compatible materials, and that enables a simple accommodation of dispensers that are filled with razor blade units and without great clamping forces prevents the razor blade units from accidentally falling out, with the arrangement being suitable not only for the ultimate user but also for the sales display of razor blade units, of wet razors, packed in dispensers.

BRIEF DESCRIPTION OF THE DRAWINGS

This object, and other objects and advantages of the present invention, will appear more clearly from the following specification in conjunction with the accompanying schematic drawings, in which:

FIG. 3 is a perspective view of a dispenser with the lid closed;

FIG. 4 shows the dispenser of FIG. 3, but with the lid flipped up;

FIG. 4*a* shows a separate lid for a dispenser;

SUMMARY OF THE INVENTION

Figure 5:
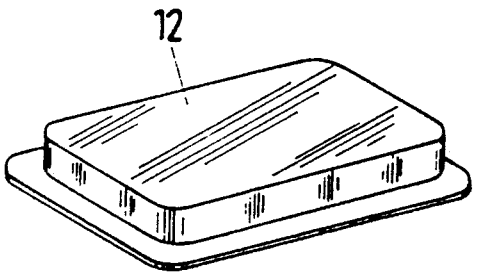
FIG. 5 is a perspective view of a tray-like packaging for a dispenser for razor blade units.

The present invention is characterized primarily in that the sales display and dispensing unit is in the form of a housing having a front side, two side walls, a top, and a bottom, with the front side stopping short of the bottom and the bottom stopping short of the front side to thereby form a first recessed portion that has a slot-like opening means to form withdrawal means for dispensing individual ones of the dispensers from the housing of the sales display and dispensing unit, with the dispensers being disposed therein in at least one row; and in that the dispensers each comprise a casing that is provided with a plurality of compartments, each of which accommodates a respective one of the razor blade units, with the casing also being provided with a lid for holding the razor blade units in the compartments in a positive manner and preventing them from falling out.

The inventive arrangement represents a technically straightforward possibility for the accommodation and display of rectangular articles, especially dispensers, in a sales dispensing unit. The customer can remove from such a unit as many dispensers as he wishes to purchase. It is merely necessary to withdraw at the bottom the appropriate number of dispensers, so that the dispensers disposed thereabove successively move or slide down. In this connection, it is particularly advantageous to grasp the individual dispensers with the thumb and forefinger, with this action being facilitated by the recessed portions that are disposed in the two side walls of the housing in the vicinity of the bottom thereof. The slot-like opening in the front side of the housing has a width that corresponds to the thickness of the dispensers, so that a customer can withdraw the dispensers only successively from the sales dispensing unit.

Pursuant to a further specific embodiment of the inventive arrangement, in the original condition the opening disposed in the sales dispensing unit is closed off by a removable safety tab. On the one hand, this prevents the dispensers from accidentally sliding out, for example during transport; on the other hand, the safety tab ensures that the dispensers cannot be tampered with. The sales dispensing unit is preferably provided in the upper region with at least one tab having an open portion so that the unit can be hung on a hook. Alternatively, or also in addition thereto, the bottom of the sales dispensing unit can be embodied as a stand means, so that the sales dispensing unit can be displayed, for example, on a table or the like.

Pursuant to another specific embodiment of the inventive arrangement, the dispensers are disposed in two rows next to one another in the housing of the sales dispensing unit, so that, for example, different razor blade units could also be displayed in a single sales dispensing unit. A partition is preferably disposed between the two rows of dispensers; by means of this partition a clear separation of the two rows of dispensers that are disposed next to one another in the housing is visible. To improve the capability for removing the two adjacent rows of dispensers, it is proposed pursuant to a further development of the inventive arrangement that the partition have a recessed portion that is disposed in the vicinity of the bottom of the sales dispensing unit. This recessed portion, together with one of the two recessed portions provided in the side walls, serves to facilitate access to the dispensers for a customer. Thus, a customer can grasp and pull the dispensers, which are to be removed individually, out of the sales dispensing unit with a thumb and forefinger, which extend into the recessed portions. After removal of the dispenser that is offered in the opening, the dispensers that are disposed thereabove slide down.

A further possibility for facilitating removal of a dispenser is provided by disposing in the bottom of the sales dispensing unit a recessed portion that enables access to the lowermost dispenser in the unit. This recessed portion is preferably semicircular.

The recessed portions that are alternatively or additionally disposed in the side walls and in the partition, preferably have the shape of a quarter of a circle. This shape conforms to the natural shape of thumbs and forefingers.

To improve the sliding down of the individual dispensers in the sales dispensing unit, each row of dispensers can be loaded with a compression spring that presses the dispensers in the direction of the bottom of the unit.

To be able to easily tell how full the sales dispensing unit of the inventive arrangement is, it is furthermore proposed to dispose in the front side of the unit at least one opening for each row of dispensers that are disposed one above the other. It is furthermore advantageous to embody this opening in a slot-like manner, with the longitudinal direction thereof being disposed in the front side parallel to the row of dispensers.

To hold the razor blade units in compartments provided in a casing of the dispenser without having to use great clamping forces, and to prevent the razor blade units from accidentally falling out, it is proposed pursuant to a further specific embodiment of the inventive arrangement that the dispensers have an additional securing means that holds the razor blade units in the compartments of the casing in a positive manner and prevents them from falling out.

This additional securing means, which operates in a positively engaging manner, ensures that when the dispensers slide down, the razor blade units will be held in the compartments and will not fall or spring out. This applies in particular after the dispenser has been supplied with used razor blade units. The inventive dispenser is particularly suitable for accommodating the new smaller razor blade units that cannot absorb great clamping forces. Since the razor blade units are now no longer held via a frictional connection, but rather are held in a positive manner in the compartments of the casing, clamping forces can be entirely or at least extensively eliminated. In particular, clamping forces are no longer needed for preventing the razor blade units from coming accidentally loose from the compartments.

Pursuant to one preferred specific embodiment of the securing means, the latter is a lid of the casing that in its securing position at least partially covers the compartments of the casing. In this manner, an easy to operate closure is provided. To remove the razor blade units from the compartments, it is merely necessary to open or remove the lid, and when not being used to again close the lid.

Pursuant to a first alternative, the lid is a component that is separate from the casing, with a fastening means being provided between the lid and the casing. In this way, the lid can be entirely removed from the casing.

In a preferred, second alternative, it is proposed that the lid be hingedly connected to the casing via a hinge, with a fixing mechanism being provided between the lid and the casing to fix the lid when it is flipped down or closed. By means of such a closure lid that can be opened and closed, there is provided in a technically extremely straightforward manner a securing means that operates in a positively engaging manner for the razor blade units that are disposed in the compartments of the casing. To remove a new razor blade unit and insert a used one, it is merely necessary to flip the lid up and then again close it after removal has been effected.

A hinge is preferably provided between the lid and the casing. This has the advantage that the casing and the lid can be assembled in a single step, which represents a considerable simplification in the manufacture of the dispenser.

Pursuant to a further specific embodiment of the present invention, it is proposed that at least one stop member be disposed between the lid and the casing; after release of the fixing mechanism, such a stop member permits the lid to be flipped up to a position that permits access to the razor blade units. The lid is preferably disposed on the housing in such a way that it is pivotable about an angle of approximately 135°.

As previously mentioned, a lid is preferably used as the securing means. The inside of this lid can be used to supply production information, especially for instructions for using the system.

In order in a simple manner to provide securement or fixation for the lid on the casing, a latching or arresting means is preferably disposed between the casing and the lid. This latching means can be integrally formed with the casing and/or the lid, so that this latching means can be molded in single operation during the actual manufacture of the dispenser. In this connection, the latching means is preferably embodied as a latching projection that is provided on the casing and that cooperates with a grip member that is disposed on the lid.

Pursuant to a further specific embodiment of the dispenser, it is proposed that in the original state a seal be disposed between the casing and the lid. Thus, after the dispenser has been mechanically filled, it is closed via a seal to prevent unauthorized access to the razor blade units disposed therein. Such a seal can, for example, be a paper sticker or label.

Pursuant to a further specific embodiment of the dispenser, it is proposed that this dispenser be disposed in an additional package. This package can be a blister card of a box. Disposing the dispenser on a blister card and in a box, especially of cardboard, represents a technically straightforward packaging possibility. However, pursuant to one preferred specific embodiment of the packaging, it is proposed that the same be a tray, especially of plastic, for accommodating the dispenser, with the tray being closed off by a removable foil or thin sheet. Such a packaging can similarly be easily produced, since after the razor blade unit dispenser has been placed into the tray, it is merely necessary to fuse the foil thereon. In this manner, the dispenser is hermetically packaged for hygienic purposes.

By means of ridges or knurling provided on the longitudinal sides of the casing, handling of the dispenser is advantageously improved.

Further specific embodiments of the present invention will be described in detail subsequently.

DESCRIPTION OF PREFERRED EMBODIMENTS

Figure 1:
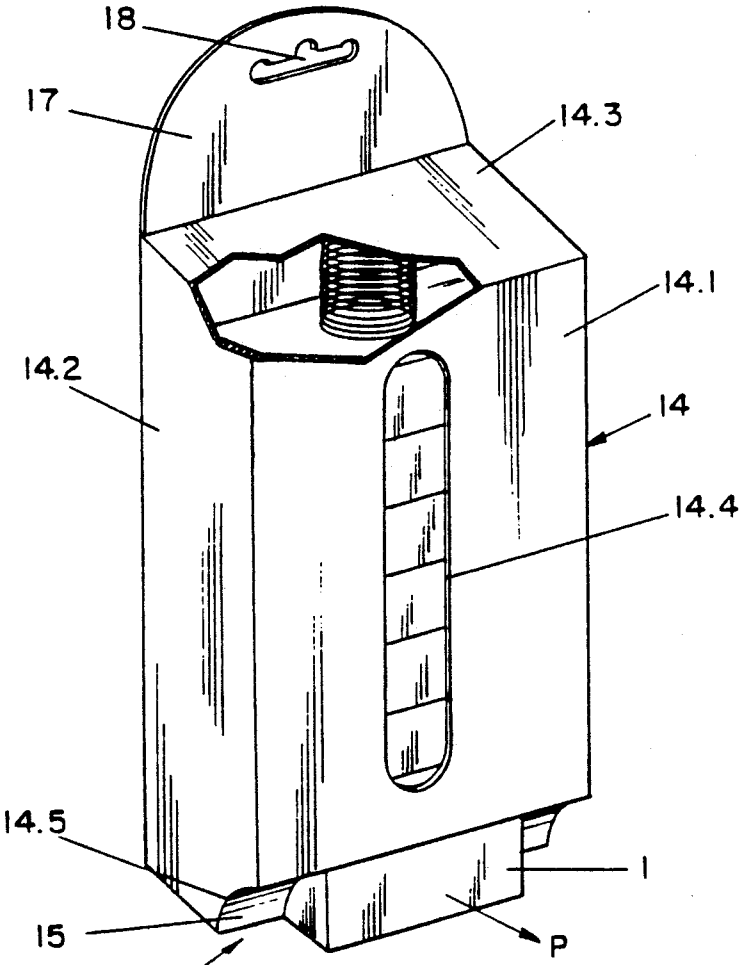
FIG. 1 is a perspective view of one exemplary embodiment of the inventive sales dispensing unit, in which the dispensers for the razor blade units are stacked.

Referring now to the drawings in detail, the means or arrangement illustrated in FIG. 1 for the accommodation and sales display of razor blade units 2 for wet razors packaged or placed in dispensers 1 has a sales dispensing unit 14 that comprises a housing which includes a front side 14.1, two side walls 14.2, a top 14.3, and a bottom 15. The front side 14.1 of the housing has a slot-like opening 14.4 that is disposed in the longitudinal direction of the unit 14 and extends nearly to the narrow sides of the front side 14.1.

The sales dispensing unit 14, in which a plurality of dispensers 1 can be accommodated and offered to customers is an essentially parallelepipedal box of plastic or cardboard the front side 14.1 of the housing of the dispensing unit 14 stops short of the bottom 15, and the bottom 15 stops short of the front side 14.1, to thereby form a recessed portion 14.5 that has a slot-like opening 16 to form withdrawal or removal means for dispensing individual ones of the dispensers from the housing of the sales display and dispensing unit, with the dispensers being disposed therein in at least one row. The width and length of the opening 16 correspond to the thickness and length of the dispensers 1 that are accommodated in the sales dispensing unit 14.

When viewed from the side walls 14.2 of the sales dispensing unit 14, the recessed portion 14.5 has the shape of a quarter of a circle.

A plurality of dispensers 1 are stacked one above the other in the sales dispensing unit 14. One can see how full the unit 14 is by means of the opening 14.4 that is disposed in the front side 14.1. To purchase one or more dispensers 1, a customer removes the appropriate number of dispensers 1 from the bottom opening 16 by reaching into the recessed portions 14.5 of the side walls 14.5 with the thumb and forefinger and pulling a dispenser 1 out of the opening 16. After the lower-most dispenser 1 has been removed, the dispensers disposed thereabove slide down. The removal of a dispenser 1 is indicated in FIG. 1 by the arrow P.

At the top, the sales dispensing unit 14 is provided with a tab 17 that is embodied as a continuation of a back wall thereof. The tab 17 is provided with an open portion 18 via which the sales dispensing unit 14 can be hung on a display hook.

Figure 2:
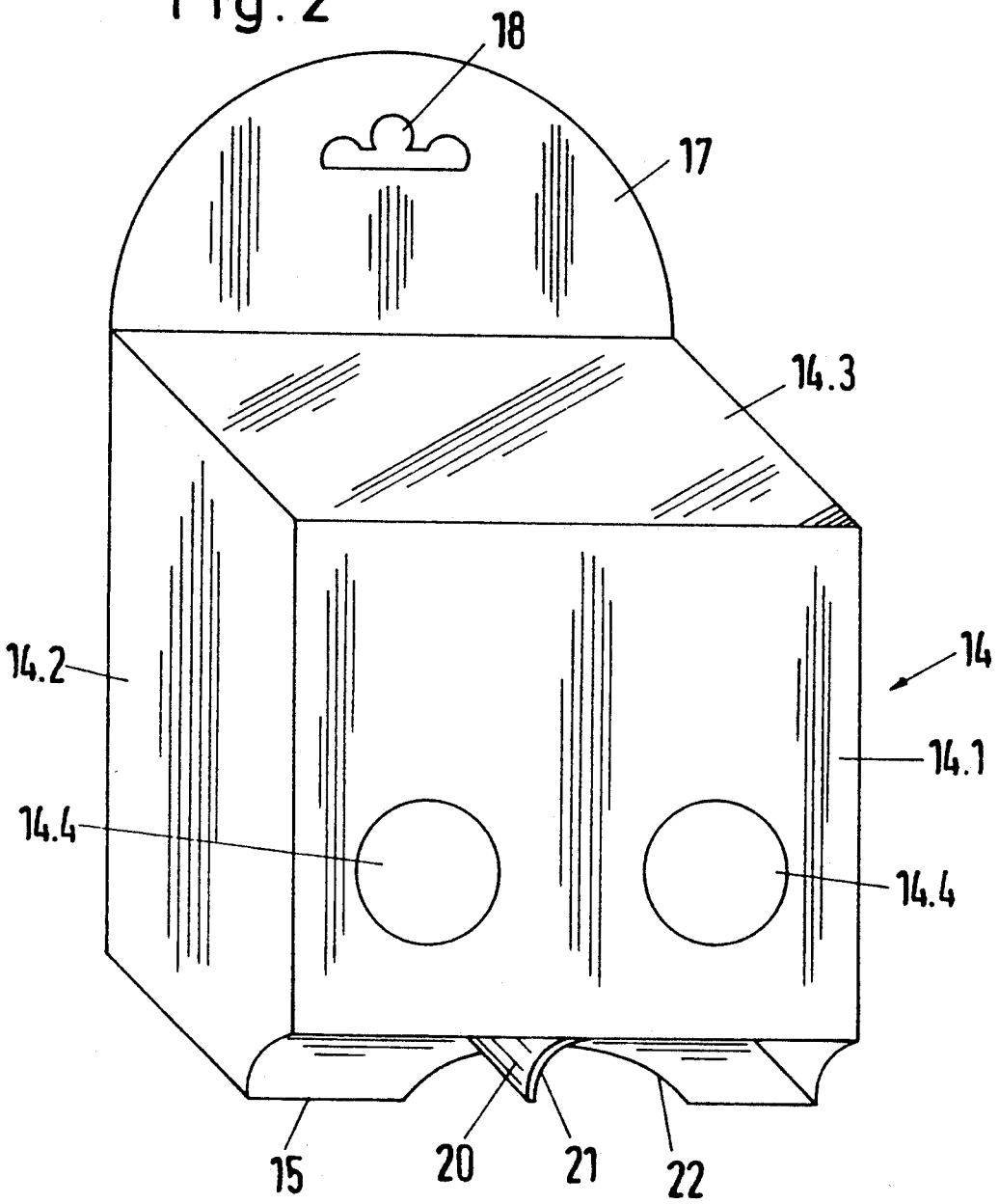
FIG. 2 is a perspective view of a second exemplary embodiment of the inventive sales dispensing unit, in which the dispensers for the razor blade units are stacked in two rows that are disposed next to one another.

FIG. 2 illustrates a second exemplary embodiment of an inventive sales dispensing unit 14, which differs from the embodiment illustrated in FIG. 1 in that two rows of stacked dispensers 1 are disposed next to one another in the unit 14. A partition 20 is disposed between the two rows of dispensers 1; the partition 20 has a recessed portion 21 that is disposed in the vicinity of the bottom 15 of the sales dispensing unit 14. In conformity with the recessed portions 14.5 that are disposed in the side walls 14.2, the recessed portion 21 has the shape of a quarter of a circle and makes it possible for a customer to grasp one of the two available dispensers 1 via a thumb and forefinger. As further indicated in FIG. 2, a further recessed portion 22 is disposed in the bottom 15 of the sales dispensing unit 14; this further recessed portion 22 has the shape of a semicircle and makes it possible to pull the dispensers 1 out.

To be able to check how full the second exemplary embodiment of the sales dispensing unit 14 that is illustrated in FIG. 2 is, circular openings 14.4 are disposed in the front side 14.1 of the unit 14 for each row of dispensers 1 stacked above one another.

FIGS. 3 and 4 illustrate a dispenser 1 for razor blade units 2. The razor blade units 2 are plastic bodies in which are embedded a single or double razor blade, and which can be disposed on the front end of the handle of a wet razor via an appropriate mechanism.

The dispenser 1 comprises a casing 3, especially of clear plastic. The casing 3 is essentially parallelepipedal and is divided into a total of five compartments 5 via crosspieces 4. A respective razor blade unit 2 is disposed in each of the compartments 5.

A lid 7 for the casing 3 is secured to the casing via a hinge 6. In FIG. 3, the dispenser 1 is closed by the lid 7, and in FIG. 4 the dispenser 1 is open, in other words the lid 7 is flipped up. In order to be able to fix the lid 7 in position in the closed state, a latching or arresting means 8 is provided between the casing 3 and the lid 7. This latching means comprises a latching projection 9 that is formed on the end of the casing 3 and in the closed state cooperates with a grip member 10 of the lid 7. By releasing the grip member 10 when the lid 7 is closed, the latching projection 9 no longer engages the same so that the lid 7 can be flipped up. To reverse the process, when the lid 7 is closed an appropriate edge thereof catches beneath the latching projection 9, which for this purpose is preferably provided on the top with an inclined abutment surface. Disposed on the long sides of the casing 3 are ridges or a knurling 23 that improves handling of the dispenser 1, and in particular facilitates the holding of the dispenser 1 during opening of the lid 7 and during removal of a razor blade unit 2. FIG. 4 schematically indicates the additional provision between the casing 3 and the lid 7 of a stop member 19 that is formed on the casing 3. The purpose of this stop member 19 is that after the latching means 8 has been released, the lid 7 can be flipped up into a position that enables access to the razor blade units 2. The lid 7 is preferably pivotable about an angle of approximately 135° relative to the casing 3.

When the lid 7 is closed as illustrated in FIG. 3, the razor blade units 2 are secured in position in the dispenser 1, i.e. are held in a positive manner in the compartments 5 so as to prevent the razor blade units 2 from falling out. When the lid 7 is opened or removed, the razor blades unit 2, which are loosely disposed in the compartments 5, can be removed or withdrawn, for example by attaching a respective razor handle to a razor blade unit 2.

It is particularly clear from the opened position of the lid 7 illustrated in FIG. 4 that the inner side of the lid 7 is provided with an information sheet 11, for example with instructions for using the system.

As an alternative to having the lid 7 attached to the casing 3, as shown in FIG. 4, it would also be possible to provide a separate lid for the dispenser, as illustrated in FIG. 4a.

Figure 6:
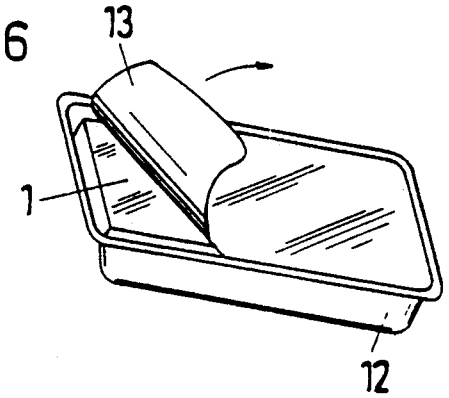
FIG. 6 shows the packaging of FIG. 5, with the cover foil on the top being partially removed for the withdrawal of the dispenser.

FIGS. 5 and 6 illustrate packaging for such a dispenser 1. This packaging comprises a tray or similar member 12 in which a respective dispenser 1 is placed and which is then closed off via a fused-on thin sheet or foil 13. In FIG. 5, the tray 12 is turned upside down, in other words with the opening toward the bottom, whereas in FIG. 6, the tray is in an upright position and shows how the foil 13 is removed to allow the dispenser 1 to be withdrawn.

The present invention is, of course, in no way restricted to the specific disclosure of the specification and drawings, but also encompasses any modifications within the scope of the appended claims.

I claim:

1. A combination of dispensers that contain razor blade units, and a sales display and dispensing unit for accommodating and individually dispensing said dispensers, comprising:

said sales display and dispensing unit in the form of a housing having a front side, two side walls, a top, and a bottom, with said front side stopping short of said bottom and said bottom stopping short of said front side to thereby together form a first recessed portion that has slot-like opening means disposed partially in said front side and partially in said bottom to form withdrawal means for dispensing individual ones of said dispensers from said housing of said sales display and dispensing unit, with said dispensers being disposed therein in at least one row; and said dispensers, each of which comprises a casing that is provided with a plurality of compartments, each of which accommodates a respective one of said razor blade units, with said casing also being provided with a lid for holding said razor blade units in said compartments in a positive manner and preventing them from falling out.

2. A combination according to claim 1, which includes a removable safety tab for closing off said slot-like opening means in an original state.

3. A combination according to claim 1, in which an upper portion of said sales dispensing unit, remote from said bottom of said housing thereof, is provided with at least one tab having an open portion to permit suspension on a hook.

4. A combination according to claim 1, in which said bottom of said housing is embodied as a support means.

5. A combination according to claim 1, in which said articles are disposed in said housing in two rows that are disposed next to one another.

6. A combination according to claim 5, which includes a partition that is disposed between said two rows.

7. A combination according to claim 6, in which said partition has a second recessed portion that is disposed in the vicinity of said bottom of said housing.

8. A combination according to claim 7, in which said bottom of said housing is provided with a third recessed portion.

9. A combination according to claim 8, in which said third recessed portion has the shape of a semicircle.

10. A combination according to claim 7, in which said first and second recessed portions have the shape of a quarter of a circle.

11. A combination according to claim 1, which includes respective compression springs for urging each row of articles in a direction toward said bottom of said housing.

12. A combination according to claim 1, which includes at least one further opening provided in said front side of said housing for each row of dispensers, which are disposed one above the other in each row.

13. A combination according to claim 1, in which said lid of said casing, in a securing position, at least partially covers said compartments of said casing.

14. A combination according to claim 13, in which said lid is a separate component from said casing, with a fastening means being provided between said lid and said casing.

15. A combination according to claim 13, which includes means for hingedly connecting said lid to said casing, and which includes fixing means between said lid and said casing for fixing said lid in a closed state.

16. A combination according to claim 15, which includes a hinge between said lid and said casing.

17. A combination according to claim 15, which includes at least one stop member disposed between said lid and said casing that, after a release of said fixing means, permits a flipping open of said lid to a position that permits access to said razor blade units.

18. A combination according to claim 15, in which said fixing means for said lid is a latching means disposed between said casing and said lid.

19. A combination according to claim 18, in which said latching means comprises a latching projection on said casing and a cooperating grip member on said lid.

20. A combination according to claim 1, in which said dispenser is disposed in an additional package.

21. A combination according to claim 20, in which said package is a blister card or a box.

22. A combination according to claim 20, in which said package is a tray, especially of plastic, for accommodating said dispenser, with a thin removable sheet being provided for closing off said tray.

23. A combination according to claim 1, in which said casing has longitudinal sides that are provided with a knurling.

24. A combination according to claim 1, in which said razor blade units are loosely disposed in said compartments of said casing in a non-securing position of said lid thereof.

25. A combination according to claim 1, in which said first recessed portion has a cross-sectional configuration corresponding to a quarter of a circle.

* * * * *